United States Patent [19]

Steckel

[11] 4,061,474

[45] Dec. 6, 1977

[54] PHENOXIDE-HALO CARBOXYLIC ACID CONDENSATE ADDITIVES FOR FUELS

[75] Inventor: Thomas Frier Steckel, Chagrin Falls, Ohio

[73] Assignee: The Lubrizol Corporation, Cleveland, Ohio

[21] Appl. No.: 608,291

[22] Filed: Aug. 27, 1975

[51] Int. Cl.[2] ..... C10L 1/18; C10L 1/32; C10L 1/22; C10M 1/54

[52] U.S. Cl. ..... 44/66; 44/51; 44/70; 44/71; 72/42; 252/42.7; 252/389 R

[58] Field of Search ..... 72/42; 252/42.7, 389 R; 44/66, 70, 51, 71

[56] References Cited

U.S. PATENT DOCUMENTS

| | | | |
|---|---|---|---|
| 3,130,160 | 4/1964 | Morway et al. | 252/42.7 |
| 3,410,798 | 11/1968 | Cohen | 252/42.7 |
| 3,493,516 | 2/1970 | Allphin et al. | 252/42.7 |
| 3,655,557 | 4/1972 | Marsh et al. | 252/42.7 |
| 3,773,664 | 11/1973 | LeSuer | 252/42.7 |

FOREIGN PATENT DOCUMENTS

| | | | |
|---|---|---|---|
| 811,648 | 6/1974 | Belgium | 252/42.7 |

*Primary Examiner*—Delbert E. Gantz
*Assistant Examiner*—Irving Vaughn
*Attorney, Agent, or Firm*—James W. Adams, Jr.; Daniel N. Hall

[57] ABSTRACT

Compositions made by reacting (I) a metal phenoxide substituted with at least one hydrocarbon-based group of at least about 30 carbon atoms with (II) a carboxylic acid reagent containing from one to three carboxyl-based groups and a halogen-substituted hydrocarbon-based aliphatic or alicyclic group containing a halogen atom are useful as additives for lubricants and normally liquid fuels. Analogous thiophenoxide-based compositions are similarly useful. These compositions are also useful as intermediates for the preparation of other useful additive compositions through their reaction with alcohols, amino compounds, reactive small ring heterocycles and basically reacting metal compounds.

12 Claims, No Drawings

PHENOXIDE-HALO CARBOXYLIC ACID CONDENSATE ADDITIVES FOR FUELS

BACKGROUND OF THE INVENTION

1. Field of the Invention

This invention relates to additive compositions for use in lubricants and normally liquid fuels. More particularly, it relates to compositions prepared by reacting a metal phenoxide substituted with at least one hydrocarbon-based group with a carboxylic acid reagent having a halogen-bearing aliphatic or alicyclic group. The invention also pertains to oil-based lubricant, normally liquid fuel and additive concentrate compositions containing these additive compositions. Products made by post-treatment of these compositions with amines, alcohols, small ring reactive heterocycles and metal salts are also useful as additives for oil-based lubricants and normally liquid fuels and are within the scope of this invention as are fuel, lubricant and concentrate compositions containing them.

2. Prior Art

Nonylphenoxy acetic acid is known as an effective anti-corrosion agent for a variety of petroleum-based fluids and synthetic lubricants such as silicones. See for example, the journal "Corrosion", Volume 16, pages 17–19 (1960).

Certain imidazoline or diamine salts of alpha substituted acetic acids of the formula:

$$R^0XCH_2COOH$$

wherein X is oxygen, sulfur or an amino group, and $R^0$ is an alkaryl, etc., group, are described as anti-corrosion agents for lubricants and normally liquid fuels in U.S. Pat. No. 3,775,320.

3. General Background

The ability of a lubricant or normally liquid fuel to inhibit corrosion of metals with which it comes in contact is becoming an increasingly sought-after property in these days of material shortages, spiraling equipment replacement costs, and environmental consciousness. Such anti-rust and/or anti-corrosion properties are often enhanced in lubricants or normally liquid fuels through use of additive organic compounds.

The ability of lubricants and normally liquid fuels to remove from metal surfaces and disperse sludge which accumulates during storage or use of a lubricant or fuel is also a highly desirable property since it allows more efficient utilization of the lubricant or fuel and prevents equipment breakdowns and deterioration. It is also desirable for a fuel or lubricant to possess properties which prevent or at least inhibit the accumulation of varnish (resinous oxidation products) on the interior engine parts such as pistons, cylinder walls and the like. Such properties are also usually obtained through the addition of organic additives to the lubricant or fuel.

The compositions of this invention and post-treated compositions made from them are useful as anti-rust and anti-corrosion additives and can impart useful detergent, dispersant, and varnish-inhibiting properties to compositions containing them.

4. Objects

Therefore, it is an object of this invention to provide additive compositions that will impart useful and desirable properties to oil-based lubricants and normally liquid fuels containing them. More specifically, it is an object of this invention to provide composition that will function in lubricants and fuels as anti-rust, anti-corrosion, anti-sludge and varnish-inhibiting agents. It is a further object to provide novel concentrates, lubricants, and fuels containing the additive compositions. Other objects will be apparent to those skilled in the art upon review of this specification.

SUMMARY OF THE INVENTION

The above-stated objects are accomplished with the present invention by reacting (I) a metal phenoxide of a phenol substituted with at least one hydrocarbon based group of at least about 30 carbon atoms or thiophenol analog thereof with (II) a carboxylic acid reagent having 1 to 3 carboxyl based groups and a hydrocarbon-based aliphatic or alicyclic group substituted with one halogen atom.

Post-treated compositions made by further reaction of these inventive compositions with mono- or polyhydric alcohols, basically reacting metal compounds, amino compounds such as mono-amines, hydrazines, hydroxyamines, polyamines, hydroxypolyamines and reactive small ring heterocycles are also within the scope of the invention as are lubricants, normally liquid fuel and additive concentrates containing these compositions and post-treated compositions.

DETAILED DESCRIPTION OF THE INVENTION

I. The metal phenoxide:

The metal phenoxides used in the present invention are of the generic formula $$Ar(W)_x(M)_y(H)_{x-y} \qquad \text{Formula 1}$$

wherein Ar is a mononuclear or fused ring aryl group bearing at least one hydrocarbon-based group as hereinafter described, each W is independently an oxygen or sulfur atom, M is an equivalent of a metal cation as hereinafter described, and $x$ and $y$ are each independently integers of 1 to 3 inclusive.

The Aryl nucleus Ar is either a mononuclear aromatic ring (e.g., benzene nucleus) or a fused ring aryl group (e.g., naphthyl, anthryl, dihydronaphthyl, tetra hydronaphthyl, etc.). Preferably Ar is a mononuclear aromatic ring, e.g., a benzene nucleus. Exemplary of monohydric phenoxides, that is, those where $x$ and $y$ are both 1, have the formula $$ArOM,\ ArSM \qquad \text{Formula 2}$$

Exemplary of dihydric phenoxides, where $x$ is 2 and $y$ is 1 or 2, are of the formulae $$Ar(O)_2(M)(H),\ Ar(O)_2(M)_2 \qquad \text{Formula 3}$$

$$Ar(S)_2(M)(H),\ \text{and}\ Ar(S)_2(M)_2$$

$$Ar(O)(S)(M)(H),\ \text{etc.}$$

Monohydric phenoxides are preferred and monohydric phenoxides wherein W is an oxygen atom are especially preferred.

The precise nature of the metallic cation M of these metal phenoxides is not critical to the practice of the invention and cations of any metal or combination of metals can be used. Generally these cations are of the Group IA, IIA, IIIA, IB and IIB metals such as lithium, sodium, potassium, magnesium, calcium, barium, strontium, copper, silver, zinc and cadmium. Aluminum, zinc, cadmium and mercury, iron, cobalt and nickel cations are also useful. For the purposes of this specification and the appended claims, the term "metal phenoxide" also includes quaternary ammonium phenoxides. Preferred cations are those of the Group IA and IIA metals.

Methods for preparing such metal phenoxides from elemental metals or basically reacting metal compounds are well known to those of skill in the art.

The aryl nucleus, Ar, of these metal phenoxides bears at least one hydrocarbon-based group of at least about 30, preferably a minimum of about 50 and a maximum of about 1000 carbon atoms. More preferably the hydrocarbon-based group has a maximum of about 250 carbon atoms. As used herein, and in the appended claims, the term "hydrocarbon-based group" denotes a group directly bonded through carbon atom to another portion of the molecule (e.g., in (I), the aromatic nucleus, Ar) and having a predominately hydrocarbon character within the context of this invention. Such groups include the following:

I. Purely hydrocarbon groups, that is, aliphatic (e.g., alkyl or alkenyl), or alicyclic (e.g., cycloalkyl or cycloalkenyl), and the like, as well as cyclic groups wherein the ring is completed through another portion of the molecule (that is, any two indicated substituents may together form an alicyclic group or aliphatic- or alicyclic-substituted groups). Such groups are known to those skilled in the art; examples include (in addition to those noted hereinafter) $C_{30}H_{61}$ — (all isomers), $C_{40}H_{79}$ — (all isomers), $C_{52}H_{105}$ — (all isomers),

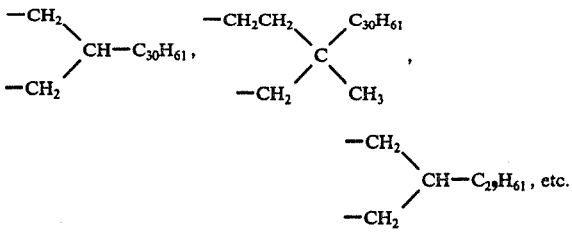

2. Substituted hydrocarbon groups, that is, groups containing non-hydrocarbon substituents which, in the context of this invention, do not alter the predominantly hydrocarbon character of the group. Those skilled in the art will be aware of suitable substituents which include groups such as:

- pendant ether substituents (especially hydrocarbyloxy and particularly alkoxy substituents of up to ten carbon atoms);
- pendant thioether substituents (especially $C_{1-10}$ alkyl thioethers such as methylmercapto, butylmercapto, etc.)
- pendant oxo groups (especially $C_{1-10}$ alkyl oxo groups such as

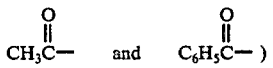

- pendant hydrocarbyl sulfonyl substituents (—$SO_2R''$ where R'' is a $C_{1-10}$ hydrocarbyl group)
- pendant carbo-oxyhydrocarbyl (e.g., —C(O)OR', R' being as above) and the analogous acyloxyhydrocarbyl substituents (e.g., —O(O)CR'', R'' being as above) pendant sulfinyl substituents (—S(O)R'', R'' being as above)

Many other such non-hydrocarbyl substituents will be apparent to those skilled in the art.

Also included within the scope of substituted hydrocarbon groups for the purpose of describing this invention are hydrocarbon groups having linkages in their main chains analogous to the pendant ether, thioether, oxo, sulfonyl and sulfinyl substituents described immediately hereinabove.

3. Hetero groups; that is, groups which while predominantly hydrocarbon in character within the context of this invention, contain atoms other than carbon present in a ring otherwise composed of carbon atoms. Suitable hetero atoms will be apparent to those skilled in the art and include, for example, oxygen, sulfur (in both its oxidized and unoxidized forms) phosphorus and nitrogen. Such hetero groups include, for example, furyl, thienyl, pyranyl, pyrrolyl, dihydro-imidazolyl, pyridyl, pyrazolyl; pyrazolinyl, indolyl, piperidyl, piperazinyl, morpholinyl, morpholino, and their hydrocarbon substituted analogs (e.g., 4-n-hexyl pryidinyl).

In general, the hydrocarbon-based groups of the phenoxides used in this invention contain no more than about three of the hereinabove-described non-hydrocarbon substituents or hetero atoms, and preferably, no more than one for each 10 carbon atoms in the hydrocarbon-based group. They also in general contain no more than one unsaturated carbon-to-carbon linkage per every ten saturated carbon-to-carbon linkages.

Generally, the hydrocarbon-based group in phenoxides used in this invention are purely hydrocarbyl and aliphatic or alicyclic in nature. Preferably, they are purely aliphatic in nature and more preferably, they are saturated aliphatic groups (i.e., containing no more than 1 carbon-to-carbon unsaturated linkage for every 20 carbon-to-carbon single bond linkages).

The sources of the hydrocarbon-based groups include principally the high molecular weight substantially saturated petroleum fractions and substantially saturated olefin oligomers and polymers, particularly oligomers and polymers of mono-olefins having from 2 to about 30 carbon atoms. The especially useful polymers are the homopolymers of 1-monoolefins such as ethylene, propene, 1-butene, isobutene, 1-hexene, 1-octene, 2-methyl-1-heptene, 3-cyclo-hexyl-1-butene, 2-methyl-5-propyl-1-hexene, 1-dodecene, 1-tetradecene, 1-octadecene, 1-cosene, 1-tetracosene, etc.

Homopolymers of medial olefins, i.e., olefins in which the olefinic linkage is not at the terminal position, likewise are useful. They are illustrated by 2-butene, 3-pentene, and 4-octene. Mixtures of these homopolymers such as a mixture of poly(propene) and poly(1-decene) can also serve as the source of the hydrocarbon-based groups.

Also useful are the interpolymers of the olefins, such as those mentioned above with other interpolymerizable olefinic substances such as aromatic olefins, cyclic olefins, and polyolefins. Such interpolymers include, for example, those prepared by polymerizing isobutene with styrene; isobutene with butadiene; propene with isoprene; ethylene with piperylene; isobutene with 1-tetradecene; isobutene with p-methyl styrene; 1-hexene with 1,3-hexadiene; 1-octene with 1-hexene; 1-heptene with 1-pentene; 3-methyl-1-butene with 1-octene; 3,3-dimethyl-1-pentene with 1-hexene; isobutene with styrene and piperylene; etc.

Mixtures of such interpolymers as well as mixtures of one or more interpolymer with one or more homopolymer can also serve as the source of the hydrocarbon-based group.

Specific examples of such interpolymers include copolymer of 95% (by weight) of isobutene with 5% of styrene; terpolymer of 98% of isobutene with 1% of piperylene and 1% of chloroprene; terpolymer of 95% of isobutene with 2% of 1-butene and 3% of 1-hexene; terpolymer of 60% of isobutene with 20 % of 1-pentene and 20% of 1-octene; copolymer of 80% of 1-hexene and 20% of 1-heptene; terpolymer of 90% of isobutene with 2% of cyclohexene and 8% of propene; and copolymer of 80% of ethylene and 20% of propene. Especially preferred souces of the hydrocarbon-based groups of this invention are homo- and interpolymers of the various butenes (i.e., isobutene, 1- and 2- butene and mixtures thereof. Particularly preferred sources are such butene polymers wherein isobutene units

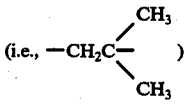

predominate, preferably to the extent of about 80% of the molecule's units and $C_{3-16}$ alpha olefin polymers and interpolymers including ethylene interpolymers.

Another source of the hydrocarbon-based groups are saturated aliphatic hydrocarbons such as highly refined high molecular weight white oils or synthetic alkanes such as are obtained by hydrogenation of the high molecular weight olefin polymers discussed above or other high molecular weight olefinic substances. Halogenated analogs (particularly chlorinated and brominated analogs) of the hydrocarbon group sources just discussed can also serve as sources of the hydrocarbon-based groups in Ar of Formula 1.

The use of olefin polymers having number average molecular weights of about 750–5000 is preferred (as measured by gel permeation chromatography of vapor pressure osmometry).

The preferred metal phenoxides of the present invention are derived from phenols having one to three hydrocarbon-based group and one hydroxide (WM) group. In these preferred phenoxides, only one of the substituents need have about 30 to about 1000 carbon atoms, the other hydrocarbon-based groups can have one to about 1000 carbon atoms. Especially preferred phenoxides are those having a single hydrocarbon-based group.

The preferred phenoxides of this invention can be represented by the formula

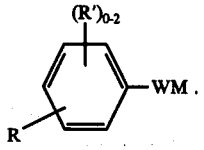

Formula 4 wherein R represents an aliphatic-based group of at least about 30 carbon atoms, R′ represents a hydrocarbon-based group of 1 to about 30 carbon atoms, W is oxygen or sulfur, and M is a metal or ammonium cation as described hereinabove. Exemplary of the R group are the lower olefin polymers described hereinbefore. (e.g., poly(isobutene) groups) while exemplary of the R′ groups are methyl, ethyl, propyl (all isomers), butyl (all isomers), hexyl (all isomers), octyl (all isomers), nonyl (all isomers), etc. up to $C_{29}H_{59}$ — (all isomers).

Mono-substituted phenoxides of Group IA and IIA metals of the formula

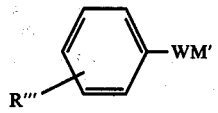

Formula 5 wherein R‴ is a purely aliphatic group of about 50 to about 250 carbon atoms, W is an oxygen or sulfur atom and M′ is a Group IA or Group IIA metal cation, are especially preferred.

Methods for making metal phenoxides from the corresponding phenols are well known to those of skill in the art and need not be dealt with in detail here. For example, phenoxides can be produced by reaction of the pure metal or a hydroxide, oxide, or hydride thereof, with the free phenols.

Methods for attaching hydrocarbon-based groups to the aromatic nucleus of phenoxides (or their phenol precursors) are equally well known in the art. For example, the production of phenols substituted with aliphatic-based groups is described in the article entitled "Alkylation of Phenols" in Kirk-Othmer "Encyclopedia of Chemical Technology", Second Edition, Volume 1, pages 894–895, Interscience Publishers, a division of John Wiley and Company, 1963. Other equally appropriate and convenient techniques for the production of phenoxides useful in this invention will occur readily to those skilled in the art.

II. The carboxylic acid reagent:

The carboxylic acid reagents used to produce the additive compositions of the present invention have 1 to 3 carboxyl-based groups, and contain a halogen-substituted hydrocarbon-based aliphatic or alicyclic group that is, a group having a halogen atom attached directly to an aliphatic or alicyclic carbon atom, i,e., a carbon atom that is part of an aliphatic- or alicyclic-based group. The use of these terms does not necessarily mean that the carboxylic acid reagent is solely or even predominantly aliphatic or alicyclic in character. For example, 1-chloro-1-phenyl acetic acid contains a chlorine atom attached to an aliphatic carbon atom (i.e., the benzyl carbon atom), but the predominant carbon atoms in the molecule are aryl in nature. Similarly, 5-bromo-1-(1-napthyl)3-cyclohexene carboxylic acid contains a predominance of aryl carbon atoms, but the bromine atom is attached to an alicyclic carbon atom.

Preferably, in these carboxylic acid reagents, the halogen atom is chlorine or bromine; also preferably it is bonded to a carbon atom which is not directly doubly bonded to another carbon atom. More preferably the chlorine or bromine atom is bonded to a carbon alpha to at least one of the carboxyl-based groups present. There are one to three halogen atoms, preferably one, in each acid reagent molecule.

Generally, these carboxylic acid reagents contain only carboxyl-based groups (as described hereinbelow) and the halogen-bearing and alicyclic group. Preferred reagents are of the formula $$A—(Cox)_{1-3}$$

Formula 6 wherein A represents a halogen-bearing, hydrocarbon-based aliphatic or alicyclic group of 1 to about 20 carbon atoms and each Cox independently represents a carboxyl-based group. Exemplary of such A groups are chloro- and bromomethyl; 1- and 2-chloro and bromoethyl; 1-, 2-, and 3-chloro- and bromo-propyl, etc. 1-, 2-, 3-, etc., chloro- and bromo- etc. cyclopentyl and cyclohexyl groups are also exemplary of the A group.

"Carboxyl-based" groups include free carboxylic acid groups, as well as carboxylic anhydride groups, carboxylate groups of any of the metals discussed hereinabove in relation to the metal phenoxides (with the same preferances expressed above), carboxylic acid ester groups of mono- and polyhydric alcohols as discussed hereinbelow and carboxylic acid nitrogen containing groups such as carboxamide and ammonium carboxylate groups of the amino compounds discussed hereinbelow.

Means for obtaining carboxylic acid reagents useful in this invention are well known to those of ordinary skill in the art. Many are commercially available chemicals; others can be readily prepared from such commercially available chemicals by reactions and techniques well known to the art. See, for example, Kirk-Othmer, "Encyclopedia of Chemical Technology", Volume 1, Pages 224 et seq., John Wiley & Sons, Inc., N.Y., N.Y., 1965.

The preferred acid reagents are esters, amides and metal and/or ammonium salts; salts and esters are particularly preferred.

Generally, these preferred acid reagents have from 1 to 2 carboxyl-based groups and they are substantially free of ethylenic or acetylenic unsaturation (i.e., having no more than one such unsaturated carbon-carbon double bond for every 10 carbon-carbon single bonds).

The alcohols which can be used to form the ester carboxylic acid reagents useful in making the compositions of this invention can be relatively simple lower mono- or dihydric hydrocarbon-based alcohols such as methanol, ethanol, the propanols, butanols, pentanols, hexanols, heptanols, including both their aliphatic and alicyclic isomers; ethylene-, propylene-, butylene-, pentylene-, hexylene-, and heptylene glycols wherein the 2 hydroxyls are separated by 2 carbon atoms; including both their aliphatic and alicyclic isomers are also useful. Tri-, tetra-, penta-, hexa- and heptamethylene glycols and hydrocarbon-substituted analogs thereof containing a total of less than 8 carbon atoms (e.g., 2-ethyl-1,3-trimethylene glycol, etc.) including their alicyclic and aliphatic analogs can be used. Phenol and the various dihydric benzene compounds (e.g., resorcinol and the hydroquinones) as well as the various cresols and hydroxy-substituted cresols and benzyl alcohol and hydroxyl-substituted analogs thereof where the second hydroxy group is directly bonded to an aromatic carbon (e.g., 3—HO—$\Phi CH_2OH$ wherein $\Phi$ is a divalent benzene ring) can also be used. In this specification, the term "lower hydrocarbon-based alcohols" refers to alcohols which contain one or two hydroxyl groups and one to seven carbon atoms. Mono and dihydric alkanols are preferred.

The carboxylic acid ester reagents useful in making the compositions of this invention can also be made from relatively higher mono- and polyhydric hydrocarbon-based alcohols. In this specification, the term "higher alcohols" refers to alcohols which contain either 8 or more carbon atoms or 3 or more (up to about 8) hydroxyl groups or both 8 or more carbon atoms and 3 or more hydroxyl groups. Preferably, they contain 8 to about 30 carbon atoms and 1 to about 6 hydroxyl groups. The higher alcohols can be aliphatic, alicyclic, mixed aliphatic alicyclic (e.g., pentyl cyclohexyl), aromatic (e.g., the naphthanols, benzohydroquinones, and phenyl-phenols), mixed aliphatic-aromatic (e.g., beta phenyl ethanol, 3-phenyl propanol, etc. as well as the ethyl-, n-decyl-, n-pentadecyl-phenols, etc.) and alicyclic-aromatic (e.g., the cyclohexyl phenols, phenyl cyclohexanols, etc.) monohydric alcohols.

Exemplary of the monohydric higher alchols are the octanols, nonanols, decanols, hexadecanols, etc. as well as the so-called fatty alcohols and their mixtures, excluding hexanols and heptanols, which are discussed in detail under the title "Higher Fatty Alcohols" in Kirk-Othmer, "Encyclopedia of Chemical Technology", Second Edition, John Wiley and Sons, N.Y., 1965, Vol. 1, pages 542–557. Among such alcohols are those known as lauryl, myristyl, cetyl, stearyl and behenyl alcohols.

Fatty alcohols containing minor amounts of unsaturation (e.g., no more than two carbon-to-carbon unsaturated bonds per molecule) are also useful and are emplified by palmitoleyl ($C_{16}H_{32}O$), oleyl ($C_{18}H_{36}O$) and eicosonyl ($C_{20}H_{40}O$) alcohols.

Higher synthetic monohydric (excluding $C_6$ and $C_7$ alcohols) alcohols such as formed by the Oxo process (e.g., 2-ethyl hexyl), the aldol condensation, and by aluminum organic (e.g., Aluminum triethyl) -catalyzed oligomerization of alpha olfins (especially ethylene) followed by oxidation are also useful. These higher synthetic alcohols are discussed in detail in the hereinabove cited "Encyclopedia of Chemical Technology", Vol. 1, at pages 560–569, which is hereby incorporated by reference for disclosures relating to higher synthetic alcohols.

Higher polyhydric alcohols containing either more than seven carbon atoms or at least 3 hydroxyl groups (and preferably up to about 8 hydroxyl groups) can also be used in making the ester carboxylic reagents of this invention. Preferably, these higher polyhydric alcohols have both more than seven carbon atoms and at least 3 hydroxyls, although some of the dihydric glycol ethers (described hereinbelow) contain only 2 hydroxyl groups, but are nevertheless useful.

Among the higher hydrocarbon-based polyhydric alcohols are the sugar alcohols of the general formula $HOCH_2(CHOH)_{2\text{-}5}CH_2OH$ such as erythritol, sorbitol, mannitol, etc., such sugar alcohols are described in detail at pages 569–588 of Vol. 1 of the "Encyclopedia of Chemical Technology" referred to hereinabove.

The various methylol polyols such as pentaerythritol and its oligomers (di- and tripentaerythritol, etc.) as well as polyols such as trimethylolethane and trimethylolpropane are also useful.

The higher dihydric glycols and glycol ethers of the general formula $HO(\text{-Alk-O})_{1\text{-}20}H$ wherein the total number of carbon atoms in all the "Alk" groups is greater than 7 and and less than about 30 can also be used in making the ester carboxylic acid reagents used in this invention. Exemplary of such glycols are the tetra and higher ethylene glycols, tripropylene glycol, dibutylene glycol, dipentylene glycol, dihexylene glycol, diheptylene glycol, and simple diols having greater than 7 carbon atoms such as 2,2,4-trimethyl 1,3-pentanediol, 1,4-cyclohexane dimethylol and 2,2,4,4-tetramethyl 1,3-cyclobutane diol. Various polymethylene diols such as 1,10-decamethane diol (i.e., 1,10-decanediol) and its higher homologs are also useful.

Mixtures of two or more of the hereinabove discussed lower and/or higher alcohols can also be used to make the carboxylic acid reagent and are often preferred for reasons of economy and/or commercial availability. The isomers of these higher alcohols are useful.

The carboxylic acid reagents used in this invention can be a nitrogen-containing carboxylic acid reagent made from one or more amino compounds. Generally, these amino compounds result in the carboxyl-based group Cox being a carboxamide although more complex groups such as carboximide (e.g., $-\overset{O}{\overset{\|}{C}}N\overset{O}{\overset{\|}{C}}-$), or carboxamidine ($-\overset{N-}{\overset{\|}{C}}-N-$)

groups can be present.

Useful amino compounds from which the carboxylic acid reagent can be derived are selected from the group consisting of monoamines, hydroxy monoamines, heterocyclic amines, polyamines, hydroxyalkyl alkylene polyamines, hydrazines, organically substituted hydrazines, hydroxylamines, and ammonia. Among the amines useful in preparing the carboxylic acid reagents are monoamines. The monoamines can be primary, secondary or tertiary. Preferably, however they are primary or secondary, i.e., they contain a $H-\overset{|}{N}-$ linkage;

more preferably they contain a primary amino group. These amines are substituted with $C_1$-$C_{30}$ hydrocarbyl groups, hydrocarbon-based groups or hydroxy-substituted hydrocarbyl groups. Generally, these groups each contain between 1 and 10 carbon atoms and are aliphatic in nature.

The hydrocarbyl groups of these monoamines can each be independently selected from alipahtic, alicyclic, aromatic groups (including aliphatic- and alicyclic-substituted aromatic groups and aromatic-substituted aliphatic and alicyclic groups). Specifically among these amines, can be, for example, methyl amine, ethyl amine, diethyl amine, 2-propyl amine, n-butyl amine, di-n-butyl amine, isobutyl amine, coco amine, stearyl amine, lauryl amine, dimethyl lauryl amine, diethyl lauryl amine, oleyl amine, aniline, paramethyl aniline, diphenyl amine, benzyl amine, tolyl amine, methyl-2-cyclohexyl amine, etc. Mixtures of such amines can also be used.

Among the hydroxy amines which can be used to make the carboxylic acid reagents of the present invention are the hydroxy-hydrocarbyl-substituted analogs of the afore-described monoamines such as ethanol amine, di-3-propanol amine, 4-hydroxybutyl amine, triethanol amine, n-methyl-2-propyl amine, 3-hydroxy aniline, etc. While it is preferred that such hydroxy amines contain only one hydroxy group per molecule, those containing more, such as diethanol amine and tris(hydroxymethyl)-methyl amine are also suitable for use in this invention. Naturally when such hydroxy amines are used, the carboxyl acid reagent can comprise mixtures of esters and ammonium carboxylates and/or carboxamides. Such mixtures are useful in this invention.

Heterocyclic amines are also useful in preparing the acid reagents (II) used to make the compositions of this invention. The cycle can also incorporate unsaturation and can be substituted with alkyl, alkenyl, aryl, alkaryl or aralkyl groups. In addition the cycle can also contain other heteroatoms such as oxygen and sulfur or other nitrogen atoms including those not having nitrogen atoms bonded to hydrogen atoms. Generally, these cycles have 3 to 10, preferably 5 to 6 ring members. Among such heterocycles are substituted and unsubstituted aziridines, azetidines, azolidines, tetra- and dihydropyridines, pyrroles, piperidines, imidazoles, indoles, di- and tetrahydroimidazoles, piperazines, isoindoles, purines, morpholines, thiomorpholines, N-aminoalkyl morpholines, N-aminoalkyl thiomorpholines, azepines, azocines, azoinines, azecinines and tetra-, di- and perhydro-derivatives of each of the above.

Polyamines are also useful in preparing nitrogen-containing carboxylic acid reagents useful in this invention. Among these polyamines are alkylene polyamines including those conforming in the most part to the formula $$A-\underset{\underset{A}{|}}{N}-(\text{Alkylene}-\underset{\underset{A}{|}}{N})_a-A \qquad \text{Formula 7}$$

wherein $a$ is an average of integers between 1 and about 10, preferably between 2 and 8; each A is independently a hydrogen atom, a hydrocarbyl group or a hydroxy-substitued hydrocarbyl group having up to about 30 atoms. Generally, A is an aliphatic or hydroxysubstituted-aliphatic group of up to about 10 carbon atoms "Alkylene" is an alkylene group of 1 to 10, preferably 2 to 6, carbon atoms. Especially preferred are the alkylene polyamines where each A is hydrogen with such ethylene polyamines being the most preferred. Such alkylene amines include ethylene polyamines, butylene polyamines, propylene polyamines, pentylene polyamines, hexylene polyamines, heptylene polyamines, etc. (wherein successive amino groups are separated by two carbon atoms). The higher homologs of such amines and related heterocyclic amines such as piperazines and aminoalkyl-substituted piperazines are also included. Polymethylene amines (e.g., trimethylene amine) are also useful in making carboxylic acid reagents.

Polyamines useful in this invention are exemplified specifically by: ethylene diamine, triethylene tetramine, tetraethylene pentamine, pentaethylene hexamine, tris(2-aminoethyl)amine, propylene diamine, trimethylene diamine, decamethylene diamine, octamethylene diamine, di(heptamethylene)amine, propylene diamine, di(heptamethylene)- triamine, tripropylene tetramine, tetraethylene pentamine, pentaethylene hexamine, di(-trimethylene)triamine, 2-heptyl-3-(2-aminopropyl-)imidazoline, 4-methylimidazoline, 1,3-bis-(2-aminoethyl)imidazoline, pyrimidine, 1-(2-aminopropyl)-piperazine, 1,4-bis(2-aminoethyl)piperazine, 2-methyl-1-(2-aminobutyl)piperazine, N-(2- and 3-propyl)morpholine, etc. Higher homologs, obtained by condensing two or more of the above-illustrated alkylene amines, likewise are useful as are mixtures of two or more of the afore-described polyamines.

Ethylene polyamines, as mentioned above, are especially useful for reasons of cost and effectiveness. Such polyamines are described in detail in the above-cited "Encyclopedia of Chemical Technology", Second Edition, Vol. 7, pages 22–93. Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines. These mixtures are particularly useful in preparing the carboxylic acid reagents of this invention. On the other hand, quite satisfactory products can also be obtained by the use of pure alkylene polyamines.

Hydroxyalkyl alkylene polyamines, i.e., alkylene polyamines having one or more hydroxyalkyl substituents on the nitrogen atoms, likewise are useful in preparing the carboxylic acid reagents of this invention. Preferred hydroxyalkyl-substituted alkylene polyamines are those in which the hydroxyalkyl group is a lower hydroxyalkyl group, i.e., having less than about 10 carbon atoms. Examples of such hydroxyalkyl-substituted polyamines include N-(2-hydroxyethyl)ethylene diamine, N,N'-bis(2-hydroxyethyl)ethylene diamine, 1-(2-hydroxyethyl)piperazine, monohydroxypropyl-substituted diethylene triamine, 1,4-bis(2-hydroxypropyl)-piperazine, di-hydroxypropyl-substituted tetraethylene pentamine, N-(3-hydroxybutyl) tetramethylene diamine, etc.

Higher homologs such as are obtained by condensation of the above-illustrated alkylene amines or hydroxy alkyl-substituted alkylene amines through amino radicals or through hydroxy radicals as well as polyamine coupled by reaction with lower aldehydes such as formaldehyde are also useful.

Useful carboxylic acid reagents can also be prepared from hydrazine or an organo-substituted hydrazine of the general formula

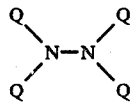

Formula 8 wherein each Q is independently hydrogen or a $C_1$–$C_{30}$ hydrocarbon-based group. Generally, at least one Q is a hydrogen atom and the other Q groups are $C_1$–$C_{10}$ aliphatic groups. More preferably at least two Q groups are hydrogen. Most preferably, at least two Q groups are hydrogen and the remaining Q groups are alkyl of up to ten carbon atoms.

Examples of substituted hydrazines are methylhydrazine, N,N-dimethylhydrazine, N,N'-dimethylhydrazine, phenylhydrazine, N-phenyl-N'-ethylhydrazine, N-(p-tolyl)-N'-(n-butyl)hydrazine, N-(p-nitrophenyl)-N-methylhydrazine, N,N'-di-(p-chlorophenyl)hydrazine, N-phenyl-N'-cyclohexylhydrazine, etc.

Useful carboxylic acid reagents can also be prepared from hydroxylamine or hydrocarbyl-substituted hydroxylamine analogs of the general formula:

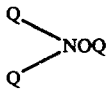

Formula 9 wherein the Q groups have the same meaning described above and the same preferences are used in choosing them.

Preferred amino compounds for preparation of the nitrogen-containing carboxylic acid reagents of this invention are lower amines having 1 to 2 amino groups or 1 amino and 1 hydroxyl group and a total of up to 7 carbon atoms per molecule, ammonia, hydrazine, hydroxylamine, and lower hydrazines and hydroxylamines having a total of up to 7 carbon atoms and a total of up to 2 nitrogen atoms per molecule. The other amines described hereinabove, for convenience, are collectively termed "higher" mono- and polyamines and "higher" hydroxyalkyl alkylene polyamines.

Mixtures of two or more of the afore-described amino compounds can also be used in making the compositions of this invention. It is preferred that the amino compounds used have at least one H—N< linkage within their structure.

In the preferred carboxylic acid reagents (II) the halogen is chlorine or bromine, the carboxyl-based group Cox is selected from the group consisting of carboxylates of Group IA metals (particularly chloroacetate salts), esters of lower alkanols (particularly chloroacetate esters), carboxamides of lower alkyl monoamines and ammonia, and carboxylates of lower alkyl monoamines and ammonia.

Among the particularly preferred carboxylic acid reagents used to produce the compositions of this invention are alpha-halo carboxyl acid reagents having 2 to 20 carbon atoms and being aliphatic- or alicyclic-based, especially those in which Cox is an ester group of a lower alkanol. Exemplary of carboxylic acid reagents are:

chloroacetic acid
ethyl chloroacetate
methyl-7-bromostearate
sodium 1,1-di-chloropropionate
di(methyl)-1-chlorosuccinate
1-chlorosuccinic anhydride
potassium phenyl chloroacetate
di(tetramethyl ammonium)-bromomalonate
calcium bromosuccinate
2-chloro-cyclohexanoic acid methyl ester
3-chloroglutaric acid
hexyl-4-chlorohexanoate
methyl 8-chlorostearate
mono-chloroacetic acid ester of pentaerythritol
3-bromobutyramide
ammonium 1-chloropropionate
sodium chloroacetate
ethyl naphthyl bromoacetate
chlorosuccinic anhydride
etc.

Other appropriate halo carboxylic acid reagents within the scope defined hereinabove will readily occur to those skilled in the art.

Normally, the compositions of this invention are made by reacting an equivalent of metal phenoxides with an equivalent of carboxylic acid reagents. An equivalent of phenoxide is determined by dividing the phenoxide molecular weight by the number of phenoxide (i.e., metal, neutralized aryl hydroxide) groups present. For example, sodium phenolate has one equivalent per mole, the dipotassium salt of resorcinol has two equivalents per mole, the mono-lithium salt of hydroquinone has one equivalent per mole, etc.

An equivalent of carboxylic acid reagent is the reagent's molecular weight when only one aliphatic halogen atom is present. While one-to-one equivalent proportions are normally used, in certain circumstances (e.g., where it is desired to drive the reaction forward), it is possible to use up to a five-fold excess (in terms of equivalents) of the acid reagent or phenoxide for each equivalent of the other reagent. Thus the reactant ratio of acid reagent to phenoxide ranges between about 1:5 to about 5:1 equivalents acid reagent:equivalents phenoxide. Mixtures of two or more acid reagents and/or phenoxide reagents can also be used.

The reaction of phenoxide and carboxylic acid reagent takes place at temperatures ranging between about 15° C. and the decomposition temperature of the rection component or product having the lowest decomposition temperature. Usually it is not necessary to carry out the reaction at a temperature in excess of about 300° C. Usually, the lowest reaction temperature is about 50° C. and the highest reaction temperature does not exceed about 200° C.

The reaction occurs normally in about 0.1–24 hours. Normally, the shortest reaction time is usually about 0.25 hour and the longest about 10 hours.

The reaction is often preferably carried out in the presence of a substantially inert, normally liquid solvent/diluent such as a relatively low boiling petroleum cut such as naphtha, textile spirits, reformate, petroleum ether, kerosene, gasoline, diesel fuel, etc., having a 90% boiling point of less than about 250° C. at atmosphere. Other organic solvents such as lower alkanols, glycols, benzene, xylenes, toluene, octanes, tetrahydrofuran, pyridine, ethyleneglycol ethers (e.g., the commercial products sold under the tradenames cellosolves and diglymes) etc., can be used as the inert solvent/diluent. Often it is desirable to use one or more of the lubricating oils described hereinbelow as an inert solvent/diluent for the reaction of the phenoxide and carboxylic acid reagent.

Recovery of the product from the phenoxide/carboxylic acid reaction can be accomplished by means well known to those skilled in the art such as distillation, crystallization, precipitation, dialysis, absorbtion, etc. Often it is not necessary to recover the product if it is to be post-treated as described hereinbelow. Sometimes when the carboxylic acid reagent is a salt it is convenient to neutralize the product by the addition of an inorganic protonic acid (e.g., $H_2SO_4$, $H_3PO_4$, HCl, $HNO_3$, etc.) before recovering or post-treating the product.

It is believed that the compositions of this invention formed by reaction of the metal phenoxide I and the carboxylic acid reagent II have predominance of ether linkage resulting from displacement of the halogen atom of the carboxylic acid reagent with a phenoxide anion. This belief is supported by the observation that significant amounts of metal halide by-products are formed during the reaction of I with II. The invention, however, is in no way limited to such ether compositions and relatively low amounts of products having other molecular structures may be present in the compositions of this invention.

The following are specific illustrative examples of how to make the aforesaid invention and include the best mode of the invention presently known. In these examples, as well as this specification and appended claims, all percentages and parts are by weight (unless otherwise stated expressly to the contrary) and the molecular weights are number average molecular weights ($\overline{M}n$) as determined by gel permeation chromatography (GPC) or vapor phase osmometry (VPO).

EXAMPLE 1

A mixture of 2240 parts of a poly(isobutene)-substituted phenol ($\overline{M}n$=885 VPO), 800 parts xylene and 83.4 parts of sodium hydroxide is heated to reflux and dried by azeotropic distillation. The resulting phenoxide-containing mixture is cooled to 100° C. and 500 parts of a commercial mixture of alcohols containing approximately 61% isobutyl alcohol and 39% amyl alcohol is added as solvent. At 65° C., 233 parts of sodium chloroacetate is then added. The mixture is held at reflux (122°–123° C.) for five hours and stripped to about 173° C. under nitrogen. After cooling the mixture to about 95° C., 200 parts of toluene and 208 parts of aqueous hydrochloric acid is added. This mixture is held at about 90°–95° C. for two hours and then stripped to 150° C. under vacuum. Diluent oil (600 parts) is added and the mixture is filtered to yield 2708 parts of an oil solution of the desired product.

EXAMPLE 2

A mixture of 784 parts (0.5 equivalent) of the product solution described in Example 1, 135 parts of toluene, 150 parts of diluent oil and 36.3 parts (0.875 equivalent) of a commercial ethylene polyamine mixture corresponding in empirical formula to pentaethylene hexamine is heated at 155°–165° C. for eight hours while water is removed by the use of a Dean-Stark trap. The mixture is stripped to 160° C. under vacuum and filtered to yield an oil solution of the desired product in an oil solution containing 1.23% nitrogen.

EXAMPLE 3

At 85° C., a mixture is prepared by adding 33 parts of paraformaldehyde to 783 parts of the solution described in Example 1, 312 parts of diluent oil, 145 parts toluene and 78 parts of a commercial ethylene polyamine mixture, wherein the amines have an average of three to ten nitrogen atoms per molecule, containing about 34% nitrogen. The resulting mixture is heated at 105° C. for two hours; then water is removed by azeotropic distillation. The mixture is stripped at 165° C. under vacuum and filtered. The filtrate (1128 parts) is an oil solution of the desired product containing 2.04% nitrogen.

EXAMPLE 4

A mixture of 627 parts of the product solution of Example 1, 219 parts of diluent oil and 27.2 parts of pentaerythritol is heated to 222° C. in 3 hours and held at 222°–230° C. for 4.5 hours. The mixture is stripped at 230° C. under vacuum and filtered to yield an oil solution of the desired product.

EXAMPLE 5

The procedure for Example 4 is repeated except the pentaerythritol is replaced on an equivalent basis by glycerol.

EXAMPLE 6

A mixture of 784 parts of the product solution of Example 1, 300 parts of diluent oil, 135 parts of toluene and 72 parts of 3-aminopropyl morpholine is reacted according to the procedure set forth in Example 2. The product solution obtained contains 40% diluent oil.

EXAMPLE 7

A mixture of 627 parts of the product solution of Example 1, 225 parts diluent oil and 36.3 parts of tris(-hydroxymethyl)aminomethane is heated at 220°–225° C. for six hours, then stripped at 160° C. under vacuum and filtered. The filtrate is an oil solution of the product.

EXAMPLE 8

A mixture of 627 parts of the product solution of Example 1 and 225 parts of diluent oil is heated to 100° C. At 100°–110° C. ethylene oxide is bubbled through the reaction mixture until a weight increase of 26 parts is obtained. The reaction mixture is stripped to 224° C. under vacuum and filtered to yield an oil solution of the desired product.

EXAMPLE 9

A mixture of 1120 parts of a poly(isobutene)-substituted phenol ($\overline{M}n$ 885 VPO), 600 parts xylene, 482 parts of diluent oil and 41.5 parts of sodium hydroxide is heated to reflux and dried by azeotropic distillation. At 73° C., 122.5 parts of ethyl chloroacetate is added and the mixture is then held at 130°-147° C. for three hours. At 60° C., 100 parts of the alcohol mixture used in Example 1, 10 parts of aqueous hydrochloric acid and 40 parts of water is added. The mixture is refluxed at 105°-107° C. for one hour, then azeotropically dried. The mixture is stripped to 170° C. under vacuum and filtered. The filtrate is a solution of the desired product.

EXAMPLE 10

The procedure for Example 6 is repeated except the product of Example 1 is replaced on an equivalent basis by the product of Example 9.

EXAMPLE 11

A mixture of 1870 parts of a poly(isobutene)-substituted ($\overline{M}n$=1600 VPO) phenol, 900 parts xylene and 41.5 parts of sodium hydroxide is heated to reflux and dried by azeotropic distillation. At 110° C., 500 parts of the alcohol mixture used in Example 1 and 116.5 parts of sodium chloroacetate is added. The resulting mixture is heated at 118° C. for ten hours, then stripped to 180° C. At 80° C., 500 parts textile spirits, 400 parts $H_2O$ and 400 parts aqueous hydrochloric acid are added. The mixture is held at 75° C. for 3 hours then stripped to 150° C. under vacuum and filtered yielding the desired product solution.

EXAMPLE 12

The procedure for Example 4 is repeated except the product of Example 1 is replaced on an equivalent basis by the product of Example 11.

EXAMPLE 13

A mixture of 746 parts of the product solution of Example 11, 600 parts diluent oil and 24.6 parts of the commercial ethylene polyamine mixture used in Example 3 is prepared at 113° C. The mixture is heated at 156°-157° C. for five hours under nitrogen while water is removed. Filtration yields the desired oil solution of product; it contains 0.6% nitrogen.

EXAMPLE 14

The procedure of Example 9 is repeated except the ethyl chloroacetate is replaced by an equimolar amount of di(ethyl)chlorosuccinate.

EXAMPLE 15

The procedure of Example 13 is repeated except the product of Example 11 is replaced on an equivalent basis by the product of Example 14.

The compositions of this invention are useful in and of themselves as anti-rust and anti-corrosion agents for fuels and lubricants, particularly when they are free acids, esters of the afore-described higher alcohols, carboxamides or ammonium carboxylates of the afore-described polyamines. These esters, carboxamides and carboxylates can also function in fuels and lubricants as detergents and dispersants for sludge and varnish formed in internal combustion engines. Thus, fuel and lubricant compositions are within the scope of the invention herein disclosed.

The compositions of this invention can be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, such as automobile and truck engines, two-cycle engines, piston engines, marine and railroad diesel engines, and the like. They can also be used in gas engines, stationary power engines, turbines and the like. Automatic transmission fluids, transaxle lubricants, gear lubricants, metal-working lubricants, hydraulic fluids and other lubricating oil and grease compositions can also benefit from the incorporation therein of the compositions of the present invention.

Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful base oils. Synthetic lubricating oils include hydrocarbon oils and halosubstituted hydrocarbon oils such as polymerized and interpolymerized olefins (e.g., polybutylenes, polypropylenes, propylene-isobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc. constitute another class of known synthetic lubricating oils. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of 1000, diphenyl ether of polyethylene glycol having a molecular weight of 500-1000, diethyl ether of polypropylene glycol having a molecular weight of 1000-1500, etc.) or mono- and polycarboxylic esters thereof, for example, the acetic acid esters, mixed $C_3$-$C_8$ fatty acid esters, or the $C_{13}$Oxo acid diester of tetraethylene glycol.

Another suitable class of synthetic lubricating oils comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra(p-tert-butylphenyl)silicate, hexyl-(4-methyl-2-pentoxy)disiloxane, poly(methyl)siloxanes, poly(methylphenyl)siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the lubricant compositions of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

In general, about 0.05–20.0, preferably about 0.1–10 parts (by weight) of a composition of this invention is dissolved or stably dispersed in 100 parts of oil to produce a satisfactory lubricant. The invention also contemplates the use of other additives in combination with the composition of this invention. Such additives include, for example, auxiliary detergents and dispersants of the ash-producing or ashless type, oxidation inhibiting agents, pour point depressing agents, extreme pressure agents, color stabilizers and anti-foam agents.

The ash-producing detergents are exemplified by oil-soluble neutral and basic salts of alkali or alkaline earth metals with sulfonic acids, carboxylic acids, or organic phosphorus acids characterized by at least one direct carbon-to-phosphorus linkage such as those prepared by the treatment of an olefin polymer (e.g., poly(isobutene) having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

The term "basic salt" is used to designate metal salts wherein the metal is present in stoichiometrically larger amounts than the organic acid radical. The commonly employed methods for preparing the basic salts involve heating a mineral oil solution of an acid with a stoichiometric excess of a metal neutralizing agent such as the metal oxide, hydroxide, carbonate, bicarbonate, or sulfide at a temperature above 50° C. and filtering the resulting mass. The use of a "promoter" in the neutralization step to aid the incorporation of a large excess of metal likewise is known. Examples of compounds useful as the promoter include phenolic substances such as phenol, naphthol, $C_{6-26}$ alkylphenols, thiophenol, sulfurized alkylphenol, and condensation products of formaldehyde with a phenolic substance; $C_{1-20}$ alcohols such as methanol, 2-propanol, octyl alcohol, cellosolve, carbitol, ethylene glycol, stearyl alcohol, and cyclohexyl alcohol; and $C_{1-20}$ amines such as aniline, phenylenediamine, phenothiazine, phenyl-$\beta$-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60°–200° C.

Ashless detergents and dispersants are so called despite the fact that, depending on its constitution, the dispersant may upon combustion yield a non-volatile material such as boric oxide or phosphorus pentoxide; however, it does not ordinarily contain metal and therefore does not yield a metal-containing ash on combustion. Many types are known in the art, and any of them are suitable for use in the lubricants of this invention. The following are illustrative:

1. Reaction products of carboxylic acids (or derivatives thereof) containing at least about 34 and preferably at least about 54 carbon atoms with nitrogen-containing compounds such as amines, organic hydroxy compounds such as phenols and alcohols, and/or basic inorganic materials. Examples of these "carboxylic dispersants" are described in British Pat. No. 1,306,529 and in many U.S. Patents, including the following: Nos.

| | | |
|---|---|---|
| 3,163,603 | 3,351,552 | 3,541,012 |
| 3,184,474 | 3,381,022 | 3,542,678 |
| 3,215,707 | 3,399,141 | 3,542,680 |
| 3,219,666 | 3,415,750 | 3,567,637 |
| 3,271,310 | 3,433,744 | 3,574,101 |
| 3,272,746 | 3,444,170 | 3,576,743 |
| 3,281,357 | 3,448,048 | 3,630,904 |
| 3,306,908 | 3,448,049 | 3,632,510 |
| 3,311,558 | 3,451,933 | 3,632,511 |
| 3,316,177 | 3,454,607 | 3,697,428 |
| 3,340,281 | 3,467,668 | 3,725,441 |
| 3,341,542 | 3,501,405 | Re 26,433 |
| 3,346,493 | 3,522,179 | |

2. Reaction products of relatively high molecular weight aliphatic or alicyclic halides with amines, preferably polyalkylene polyamines. These may be characterized as "amine dispersants" and examples thereof are described, for example, in the following U.S. Patents:

| | |
|---|---|
| 3,275,554 | 3,454,555 |
| 3,438,757 | 3,565,804 |

3. Products obtained by post-treating the carboxylic or amine dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Patents:

| | | |
|---|---|---|
| 3,036,003 | 3,367,943 | 3,579,450 |
| 3,087,936 | 3,373,111 | 3,591,598 |
| 3,200,107 | 3,403,102 | 3,600,372 |
| 3,216,936 | 3,442,808 | 3,639,242 |
| 3,254,025 | 3,455,831 | 3,649,229 |
| 3,256,185 | 3,455,832 | 3,649,659 |
| 3,278,550 | 3,493,520 | 3,658,836 |
| 3,280,234 | 3,502,677 | 3,697,574 |
| 3,281,428 | 3,513,093 | 3,702,757 |
| 3,282,955 | 3,533,945 | 3,703,536 |
| 3,312,619 | 3,539,633 | 3,704,308 |
| 3,366,569 | 3,573,010 | 3,708,522 |

4. Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. Patents: Nos.

| | |
|---|---|
| 3,329,658 | 3,666,730 |
| 3,449,250 | 3,687,849 |
| 3,519,565 | 3,702,300 |

The pertinent disclosures of all of the above-noted patents are incorporated by reference herein.

Extreme pressure agents and corrosion-inhibiting and oxidation-inhibiting agents are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate; phosphorus esters including principally dihydrocarbon and trihydrocarbon phosphites such as dibutyl phosphite, diheptyl phosphite, dicyclohexyl phosphite, pentyl phenyl phosphite, dipentyl phenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

The fuel compositions of the present invention contain a major proportion of a normally liquid fuel, usually a hydrocarbonaceous petroleum distillate fuel such as motor gasoline as defined by ASTM Specification D-439-73 and diesel fuel or fuel oil as defined by ASTM Specification D-396. Normally liquid fuel compositions comprising nonhydrocarbonaceous materials such as alcohols, ethers, organo-nitro compounds and the like (e.g., methanol, ethanol, diethyl ether, methyl ethyl ether, nitromethane) are also within the scope of this invention as are liquid fuels derived from vegetable or mineral sources such as corn, alfalfa, shale and coal. Normally liquid fuels which are mixtures of one or more hydrocarbonaceous fuels and one or more nonhydrocarbonaceous materials are also contemplated. Examples of such mixtures are combinations of gasoline and ethanol, diesel fuel and ether, gasoline and nitromethane, etc. Particularly preferred is gasoline, that is, a mixture of hydrocarbons having an ASTM boiling point of 60° C. at the 10% distillation point to about 205° C. at the 90% distillation point.

Generally, these fuel compositions contain an amount of the compositions of this invention sufficient to impart anti-rust, anti-corrosion, dispersant and/or detergent properties to the fuel; usually this amount is about 1 to about 10,000, preferably 4 to 1,000 parts by weight of the reaction product per million parts by weight of fuel. The preferred gasoline-based fuel compositions generally exhibit excellent engine oil sludge dispersancy and detergency properties.

The fuel compositions of this invention can contain, in addition to the compositions of this invention, other additives which are well known to those of skill in the art. These can include anti-knock agents such as tetraalkyl lead compounds, lead scavengers such as haloalkanes (e.g., ethylene dichloride and ethylene dibromide), deposit preventors or modifiers such as triaryl phosphates, dyes, cetane improvers, anti-oxidants such as 2,6-di-tertiarybutyl-4-methylphenol, rust inhibitors, such as alkylated succinic acids and anhydrides, bacteriostatic agents, gum inhibitors, metal deactivators, demulsifiers, upper cylinder lubricants, anti-icing agents and the like.

In certain preferred fuel compositions of the present invention, the afore-described compositions of this invention are combined with other ashless dispersants in gasoline. Such ashless dispersants are preferably esters of a mono- or polyol and a high molecular weight mono- or polycarboxylic acid acylating agent containing at least 30 carbon atoms in the acyl moiety. Such esters are well known to those of skill in the art. See, for example, French Pat. No. 1,396,645, British Pat. Nos. 981,850 and 1,055,337 and U.S. Pat. Nos. 3,255,108; 3,311,558; 3,331,776; 3,346,354; 3,522,179; 3,579,450; 3,542,680; 3,381,022; 3,639,242; 3,697,428; 3,708,522; and British Pat. Specification No. 1,306,529. These patents are expressly incorporated herein by reference for their disclosure of suitable esters and methods for their preparation. Generally, the weight ratio of the compositions of this invention to the aforesaid ashless dispersants is about 0.1 to about 10.0; preferably about 1 to about 10 parts of composition of this invention to 1 part ashless dispersant.

In still another embodiment of this invention, the inventive additives are combined with Mannich condensation products formed from substituted phenols, aldehydes, polyamines, and amino pyridines. Such condensation products are described in U.S. Pat. Nos. 3,649,659; 3,558,743; 3,539,633; 3,704,308; and 3,725,277.

The compositions of this invention can be added directly to a fuel or lubricating oil to form the fuel and lubricant compositions of this invention or they can be first diluted with a substantially inert, normally liquid organic solvent/diluent such as mineral oil, xylene, or a normally liquid fuel as described above, to form an additive concentrate which is then added to the fuel or lubricating oil in sufficient amounts to form the inventive fuel and lubricant composition described herein. These concentrates generally comprise about 20 to about 90 percent of a composition of this invention and can contain in addition any of the above-described conventional additives, particularly the afore-described ashless dispersants in the aforesaid proportions. The remainder of the concentrate is the solvent/diluent.

As well as serving as additives in and of themselves, the compositions of this invention can be post-treated with a variety of chemical reagents to form post-treated compositions which are also useful as additives in the aforedescribed fuels and lubricants. These post-treated additives are used in concentrations having the same general ranges set forth above and can also be formulated into concentrates as described above. They can also be used with compatible auxiliary additives such as those already discussed.

When the compositions of this invention are to be used in post-treatment reactions, it is preferred that they be free carboxylic acids, anhydrides, esters of lower alcohols, carboxamides of ammonia, lower monoamines and carboxylates of ammonia, lower monoamines or metals, especially Group IA, IIA and IIB metals. The post-treatment reagents include the above-described higher mono- and polyhydric alcohols, especially the higher polyhydric alcohols and the abovedescribed polyamines and hydroxy alkyl alkylene polyamines, especially the alkylene polyamines. Mixtures of these post-treating reagents can also be used. Particularly preferred are mixtures of the afore-described polyhydric triols and tetraols with the afore-described ethylene polyamines.

Reactions of the composition of this invention with the afore-described post-treating reagent are carried out under the same general conditions set forth hereinabove for reactions used to form the carboxylic acid reagents. Similarly, the general proportions set forth for forming the carboxylic acid reagent can be used in the post-treating reactions, thus, an equivalent of the composition of this invention can be reacted with 1-5 equivalents of the aforedescribed post-treating reagents. An equivalent of the composition of this invention is defined as its molecular weight divided by the number of carboxylic acid groups contained therein, i.e., carboxylic acid, anhydride ester, carboxamide, carboxylate group. An equivalent of a metallic post-treating reagent is its molecular weight or atomic weight divided by the valence. Thus, sodium, lithium, potassium, etc. have equivalent weights equal to their atomic weights while calcium, zinc and barium, etc., have equivalent weights which are half their atomic weights. The equivalent weight of a polyamine or polyhydric alcohol is its molecular weight divided by the number of hydroxyl and/or amino groups present.

The oils described hereinabove are particularly useful in solvent/diluents for post-treatment reactions, although the reactions can also be carried out without the presence of a solvent/diluent or in the presence of a solvent/diluent such as the relatively low boiling organic liquids set forth hereinabove in relation to the reactions used to form the carboxylic acid reagents.

The compositions of this invention can also be post-treated with reactive three and four membered ring heterocyclic compounds such as epoxides, episulfides, ethylene amines, oxetanes, azetanes, etc. Such reactive heterocycles have the general formula

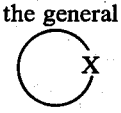

wherein the circle represents a chain of 2 or 3 carbon atoms and X is an oxygen, sulfur or >NQ group, Q being a hydrogen or a $C_{1-30}$ hydrocarbon-based group. Each of the carbon atoms of the circle can be substituted with hydrogen or a Q group as defined above, preferably, however, they are substituted with hydrogen and/or a single methyl group as in ethylene oxide, propylene oxide, etc. Post-treatments with the 3 and 4 membered ring heterocycles can be carried out in conditions well known to those of skill in the art. Generally, such post treatments occur at temperatures between 0° C. Preferably, they are carried out at temperatures of 15° C. to about 40° C. Such post-treatment reactions can be carried out in a period as short as about 0.1 hour or as long as bout 48 hours. Preferably, they are carried out in a period of about 1 to about 10 hours. At least about 0.5 mole to about 20 moles of heterocycle per equivalent of the composition of this invention is used in these post-treatment reactions. It is also possible to use mixtures of the 3 and 4 membered ring heterocycles as post-treating reagents and mixtures of these heterocycle reagents with other post-treating reagents described hereinbefore.

Post-treatments of the products of this invention can also be carried out with reagents such as elemental sulfur, carbonoxy sufide, or carbon disulfide. Such post-treatments are carried out under the same general conditions as described hereinbefore with small ring heterocycle post-treatments and involve the same reactant proportions as the latter.

Compositions of this invention can also be overbased with Group IA, IIA and IIB basically reacting metal compounds. Especially preferred compositions for such overbasing are those compositions containing a free carboxylic acid group or carboxylate metal or ammonium salt group. These materials are analogous to the well known overbased acids which are described in U.S. Pat. Nos. 3,567,637 and 3,147,232; U.S. Pat. No. 2,258,591; and U.S. Pat. No. 2,252,662. Generally, the overbased compositions are made by reacting a carboxylate or carboxylic acid made according to this invention with a basically reacting metal oxide, hydroxide, alkoxide or phenoxide in the presence of an inorganic acidic material such as, for example, $CO_2$, $SO_2$, $H_2S$, HCl, etc., and a promoter such as, for example, water, lower alcohols and phenols, fatty carboxylic acids (e.g., acetic acid) and their salts, and lower ketones and aldehydes. Generally, these overbasing reactions are carried out between about 25 and about 150° C. for about 0.25 to about 25 hours using about 2.5 to 30 moles of basically reacting metal compound to each equivalent of carboxyl compound (as defined hereinabove). Further details as to making these overbased materials are generally known to those skilled in the art as shown by the above-noted patents and are closely analogous to those used to form the ash-forming basic salt dispersants discussed hereinabove. Therefore, these patents are incorporated by reference for their teachings of how to overbase carboxylic acid compounds. Compositions wherein the carboxylic acid reagent is a succinic acid reagent are particularly preferred for overbasing treatments.

The following are examples of lubricating oil, fuel oil and concentrate compositions containing the compositions of this invention.

EXAMPLE A

A lubricating oil composition containing 2.5% of the oil solution described in Example 2.

EXAMPLE B

A gasoline suitable for use in automotive engines containing in addition to the conventional dye and anti-knock compounds, 0.001% of the oil solution described in Example 4.

EXAMPLE C

A diesel fuel containing in addition to a conventional anti-oxidant additive, 0.5% of the oil solution described in Example 13.

EXAMPLE D

A lubricating oil composition for gasoline engines graded 10W-40 according to SAE standards and having as a base oil a mixture of a solvent-refined 100 neutral and solvent-refined 200 neutral oil in equal amounts by volume and containing the following additives:

| Additive | Amounts |
|---|---|
| Polymeric VI Improver | 13%* |
| Zinc Dithiophosphate | 1.3% |
| Over-based Magnesium Sulfonate | 0.9% |
| Phenolic Anti-oxidant | 1%* |
| Sulfurized hydrocarbon E.P. Agent | 0.3%* |
| Ethoxylated Surfactant | 0.3%* |
| Carboxylic Acid Rust Inhibitor | 0.1%* |
| Silicone Anti-foamant | 100 ppm |
| Oil Solution Described in Example 13 | 5.5% |
| The balance of the lubricant composition is the base oil. | |

*by % by volume

EXAMPLE E

An additive concentrate suitable for formulating additive packages for use in fuels and lubricants comprising 50% of the oil solution of Example 15 and 50% of the base oil described in Example D.

What is claimed is:

1. A normally liquid fuel composition comprising a major amount of a normally liquid fuel and about 1–10,000 parts per million parts by weight of fuel of a product made by reacting at least one (I) metal phenoxide substituted with at least one hydrocarbon group of at least about 30 carbon atoms with (II) a carboxylic acid reagent containing from 1 to 3 Cox groups and a halogen-substituted hydrocarbon aliphatic or alicyclic group, the ratio of equivalents of acid reagent to equivalents of phenoxide ranging between about 1:5 to about 5:1, wherein each Cox independently represents a member selected from the group consisting of a carboxylate of a Group IA metal, a carboxylic ester of a lower alkanol, a carboxamide of lower alkyl monoamines or ammonia, and a carboxylate of a lower alkyl monoamine or ammonia.

2. A composition as claimed in claim 1 wherein (I) is of the formula $$Ar(W)_x(M)_y(H)_{x-y}$$

wherein Ar is a mononuclear aryl group bearing at least one hydrocarbon group of at least about 30 carbon atoms, each W is independently an oxygen or sulfur atom, M is an equivalent of a metal cation and $x$ and $y$ are each independently integers of 1 to 3.

3. A composition as claimed in claim 2 wherein the metal cation M is of a Group IA, Group IIA, Group IIIA, Group IB or Group IIB metal or mixtures thereof.

4. A composition as claimed in claim 3 wherein the hydrocarbon group contains up to about 250 carbon atoms.

5. A composition as claimed in claim 1 wherein the carboxylic acid reagent (II) is of the formula $A\text{-}(Cox)_{1\text{-}3}$ wherein A represents a halogen-bearing hydrocarbon aliphatic or alicyclic group of 1 to about 20 carbon atoms and each Cox independently represents a member of the group consisting of carboxylate and carboxamide.

6. A composition as claimed in claim 2 wherein the carboxylic acid reagent (II) is of the formula $A\text{-}(Cox)_{1\text{-}3}$ wherein A represents a halogen-bearing hydrocarbon aliphatic or alicyclic group of 1 to about 20 carbon atoms and each Cox independently represents a member of the group consisting of carboxylate and carboxamide.

7. A composition as claimed in claim 6 wherein the halogen is chlorine or bromine, the Cox group is selected from the group consisting of carboxylates of Group IA metals, carboxylic esters of lower alkanols, carboxamides of lower alkyl mono-amines and ammonia, and carboxylates of lower alkyl mono-amines.

8. A composition as claimed in claim 7 wherein the carboxylic acid reagent (II) is a lower alkanol ester of chloroacetic acid or a Group IA metal chloroacetate.

9. A normally liquid fuel composition comprising a major amount of a normally liquid fuel and about 1–10,000 parts per million parts by weight of fuel of a product made by reacting at least one (I) phenoxide of the formula $$Ar(W)_x(M)_y(H)_{x-y}$$

wherein Ar is a mononuclear aryl group bearing at least one hydrocarbon group of at least about 30 to about 250 carbon atoms, each W is independently an oxygen or sulfur atom, M is an equivalent of a metal cation and $x$ and $y$ are each independently integers of 1 to 3, with (II) at least one carboxylic acid reagent of the formula $A\text{-}(Cox)_{1\text{-}3}$ wherein A represents an aliphatic or alicyclic group containing at least one halogen atom and from 1 to about 20 carbon atoms, each Cox independently representing a member selected from the group consisting of a carboxylate of a Group IA metal, a carboxylic ester of a lower alkanol, a carboxamide of lower alkyl monoamines or ammonia, and a carboxylate of a lower alkyl monoamine or ammonia, the ratio of equivalents of acid reagent to equivalents of phenoxide ranging between about 1:5 to about 5:1.

10. A composition as claimed in claim 9 wherein (I) is of the formula

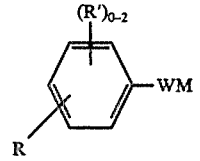

wherein R represents an aliphatic group of at lest about 30 carbon atoms, R′ represents a hydrocarbon-based group of 1 to about 30 carbon atoms, W is an oxygen or sulfur atom, and M is metal or ammonium cation, halogen is chlorine or bromine, and the Cox group is selected from the group consisting of carboxylates of Group IA metals, carboxylic esters of lower alkanols, carboxamides or lower alkyl mono-amines and ammonia and carboxylates of lower alkyl mono-amines and ammonia.

11. A normally liquid fuel composition comprising a major amount of a normally liquid fuel and about 1–10,000 parts per million parts by weight of fuel of a second product made by reacting at least one polyamine, higher polyhydric alcohol or mixture thereof with a first product made by reacting at least one phenoxide (I) of the formula

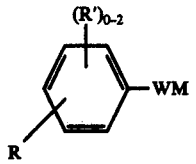

wherein R represents an aliphatic group of at least about 30 carbon atoms, R' represents a hydrocarbon group of 1 to about 30 carbon atoms, W is an oxygen or sulfur atom and M is a metal or ammonium cation with (II) at least one carboxylic acid reagent of the formula $A\text{-}(Cox)_{1\text{-}3}$ wherein A represents an aliphatic or alicyclic group of at least 1 to about 20 carbon atoms containing at least one chlorine or bromine atom and each Cox independently represents a carboxylate of a Group IA metal, carboxylic ester of a lower alkanol, carboxamide of lower alkyl monoamines or ammonia, or carboxylate of a lower alkyl monoamine or ammonia, the ratio of equivalents of acid reagent (II) to equivalents of phenoxide (I) ranging between about 1:5 to about 5:1.

12. A normally liquid fuel composition comprising a major amount of a normally liquid fuel and about 1–10,000 parts per million parts by weight of fuel of an overbased, metal carboxylate made by reacting at least one basically reacting Group IIA oxide, hydroxide or alkoxide of a lower alkanol in the presence of a promoter and an acidic reagent with a product made by reacting at least one metal phenoxide (I) of the formula $$Ar(W)_x(M)_y(H)_{x\text{-}y}$$

wherein Ar is a mononuclear aryl group bearing at least about 30 carbon atoms, each W is independently an oxygen or sulfur atom, M is an equivalent of a metal cation wherein the metal is selected from the group consisting of Group IA, Group IIA, Group IIIA, Group IB, Group IIB and mixtures thereof, and x and y are each independently integers of 1 to 3 with (II) a carboxylic acid reagent containing from 1 to 3 Cox groups, wherein each Cox is independently selected from the group consisting of a carboxylate of a Group IA metal, a carboxylic ester of a lower alkanol, a carboxamide of lower alkyl monoamines or ammonia, and a carboxylate of a lower alkyl monoamine or ammonia, and a halogen-substituted hydrocarbon aliphatic or alicyclic group, the ratio of equivalents of acid reagents (II) to equivalents of phenoxide (I) ranging between about 1:5 to about 5:1.

* * * * *